US005619947A

United States Patent [19]

Lewis

[11] Patent Number: 5,619,947

[45] Date of Patent: Apr. 15, 1997

[54] RELEASABLE ANCHOR

[76] Inventor: J. Douglas Lewis, HC 79, Box 20, Burwell, Nebr. 68823-9602

[21] Appl. No.: 499,350

[22] Filed: Jul. 7, 1995

[51] Int. Cl.[6] ..... B63B 21/32

[52] U.S. Cl. ..... 114/297; 114/301

[58] Field of Search ..... 114/230, 221 R, 114/293, 294, 297, 301

[56] References Cited

U.S. PATENT DOCUMENTS

| | | | |
|---|---|---|---|
| 1,339,697 | 5/1920 | England | 114/294 |
| 2,278,594 | 4/1942 | Smith | 114/294 |
| 2,585,089 | 2/1952 | Caldwell et al. | 114/294 |
| 2,743,695 | 5/1956 | Bowman | 114/301 |
| 3,305,984 | 2/1967 | Borcuk | 114/301 |
| 3,430,596 | 3/1969 | Hysaw | 114/208 |
| 3,491,712 | 1/1970 | Ross | 114/208 |
| 3,593,682 | 7/1971 | Zitzow | 114/208 |
| 3,776,172 | 12/1973 | Lambert | 114/208 |
| 4,057,024 | 11/1977 | Adams | 114/298 |
| 4,111,147 | 9/1978 | Morissette | 114/298 |
| 4,145,835 | 3/1979 | Snow | 43/96 |
| 4,380,207 | 4/1983 | Nolt | 114/298 |
| 4,417,538 | 11/1983 | El-Ramey | 114/298 |
| 4,543,904 | 10/1985 | Puoti | 114/294 |
| 4,567,841 | 2/1986 | Hale | 114/221 R |
| 4,577,582 | 3/1986 | Hedden | 114/298 |
| 5,154,131 | 10/1992 | Hall | 114/294 |

*Primary Examiner*—Stephen Avila
*Attorney, Agent, or Firm*—Zarley, McKee, Thomte, Voorhees & Sease; Mark D. Frederiksen

[57] ABSTRACT

A releasable anchor includes a generally "J" shaped fluke formed of a resilient material which has memory to return the fluke to a "J" shape after a biasing force has been applied thereto. Preferably, the fluke is formed of a strap of spring steel and has a weight affixed to the free end so as to direct the fluke's free end downwardly through the water. One or more flukes may be connected to form variations in anchor shape.

7 Claims, 2 Drawing Sheets

RELEASABLE ANCHOR

TECHNICAL FIELD

The present invention relates generally to anchors for watercraft, and more particularly to an improved anchor which is releasable from engagement with an underwater object.

BACKGROUND OF THE INVENTION

A common fishing area in a lake is typically found near trees, wherein underwater tree branches and roots provide likely areas to find fish. However, conventional rigid arm anchors can become easily fouled within the trees. Retrieval of an anchor once it has become entangled is time consuming, and it is quite likely that the fisherman would be forced to cut the anchor line and thereby lose the anchor.

It is known in the prior art that anchors can be designed with a release feature which can be operated by the fisherman or boat operator. For example, U.S. Pat. No. 4,577,582 discloses an anchor having a tubular shank with an elongated control member which will pivot the flukes of the anchor between an extended position and a retracted position.

U.S. Pat. No. 4,543,904 discloses a collapsible arm anchor with one or more arms hinged to a tubular shank which are pivotable between extended and retracted positions.

Many other patents also disclose anchors having selectively pivotable flukes, including U.S. Pat. No. 4,417,538, U.S. Pat. No. 4,380,207, U.S. Pat. No. 4,111,147, U.S. Pat. No. 4,057,024, U.S. Pat. No. 3,593,682, U.S. Pat. No. 3,491,712, and U.S. Pat. No. 3,430,596.

However, all of these anchors require mechanical pivoting or other actuation of the anchor flukes in order to operate. This increases the possibility of mechanical failure or other necessary repair.

Another problem with prior art releasable anchors is the expense associated with purchasing a relatively complex mechanical apparatus.

SUMMARY OF THE INVENTION

It is therefore a general object of the present invention to provide an improved releasable anchor.

Another object is to provide a releasable anchor which has no pivoting or rotatable connections, nor mechanical interaction.

A further object of the present invention is to provide a releasable anchor which is simple to operate and economical to manufacture.

Still another object is to provide a releasable anchor which is simple to make and use.

These and other objects will be apparent to those skilled in the art.

The releasable anchor of the present invention includes a generally "J" shaped fluke formed of a resilient material which has memory to return the fluke to a "J" shape after a biasing force has been applied thereto. Preferably, the fluke is formed of a strap of spring steel and has a weight affixed to the free end so as to direct the fluke's free end downwardly through the water. One or more flukes may be connected to form variations in anchor shape.

BRIEF DESCRIPTION OF THE DRAWINGS

FIG..3 is a perspective view of a third embodiment of the anchor of the present invention.

DESCRIPTION OF THE PREFERRED EMBODIMENT

Figure 4:
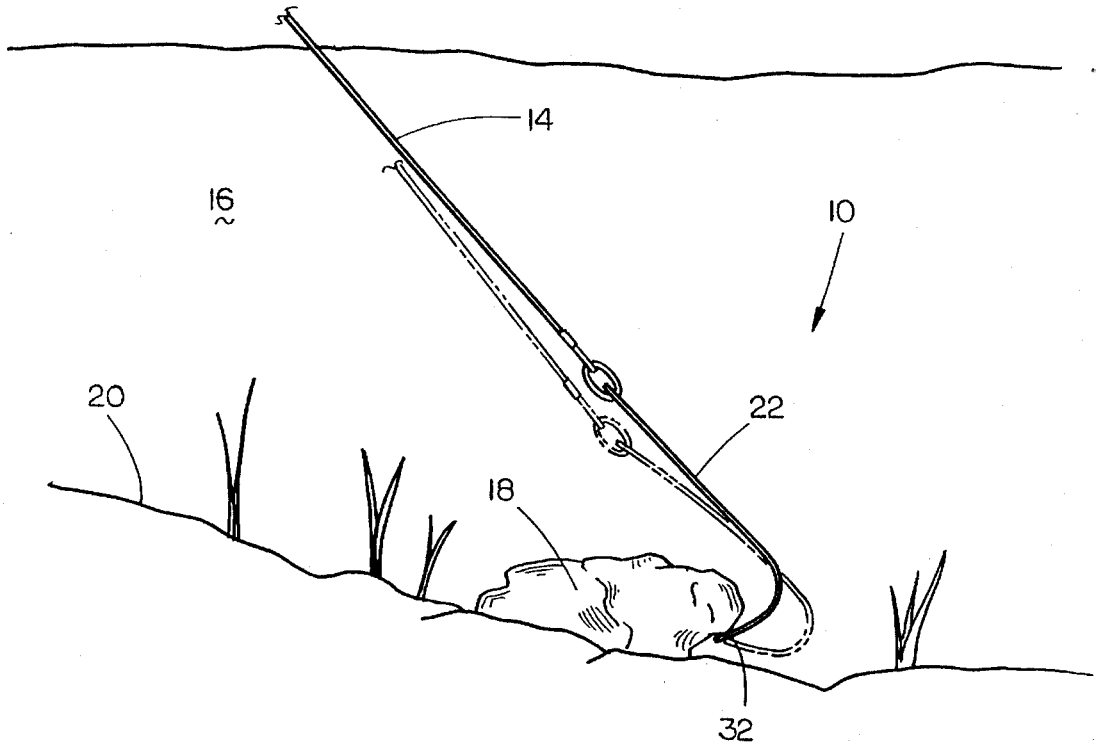
FIG. 4 is a pictorial view of the first embodiment of the anchor in operation.

Referring now to the drawings, in which similar or corresponding parts are identified with the same reference numeral and more particularly to FIG. 4, the releasable anchor of the present invention is designated generally at 10 and is shown connected to a boat or other craft via a rope 14. Anchor 10 is submerged in water 16 and has engaged a rock 18 on the bottom 20 of a lake.

Figure 1:
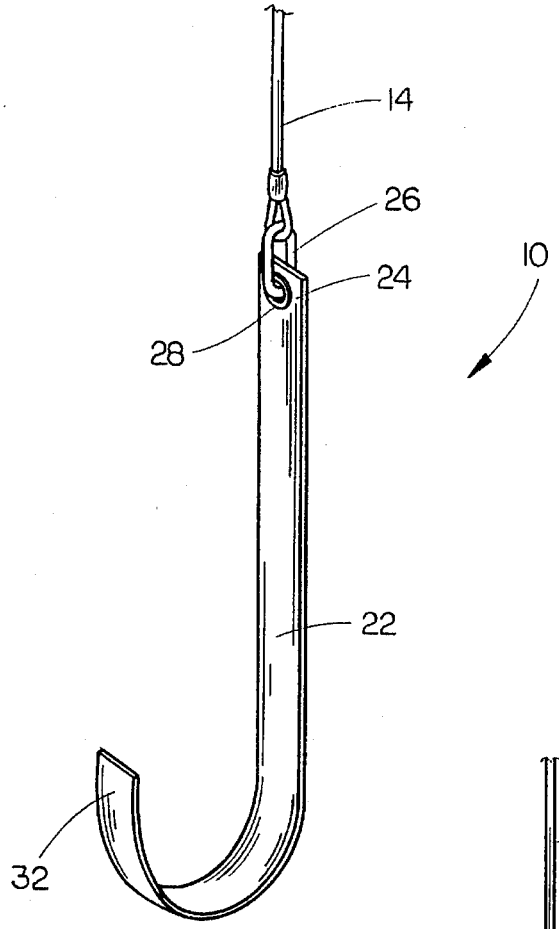
FIG. 1 is an enlarged perspective view of the anchor of the present invention.

Referring now to FIG. 1, anchor 10 includes a fluke 22 formed of a strap of string steel in a general "J" shape. Fluke 22 includes a crown end 24 which is attached to rope 14 by a ring 26 engaged through an aperture 28 in fluke 22.

While fluke 22 is preferably formed of a spring steel material, other materials having resilient flexible characteristics, with retained memory, may be substituted. In this way, fluke 22 retains the memory of the "J" shape, but may be biased to a straightened position, shown in FIG. 4, upon the application of a predetermined force on the free end 32 of fluke 22.

In operation, the weight of anchor 10 will cause the anchor to drop to the bottom of the body of water 16, as shown in FIG. 4. The "J" shape of fluke 22 will cause the free end 32 to engage a rock 18, tree branch, or other object on the bottom 20 of the lake so as to retain a boat in a desired position on the water. The resilience of the material of fluke 22 permits the boat operator to pull on rope 14 with a predetermined amount of pressure so as to bias fluke 22 out of the "J" shaped position to a straighter position thereby releasing anchor 10 from the rock 18 or other object. Anchor 10 is then retrieved from the water 16 to permit a boat to move on.

Figure 2:
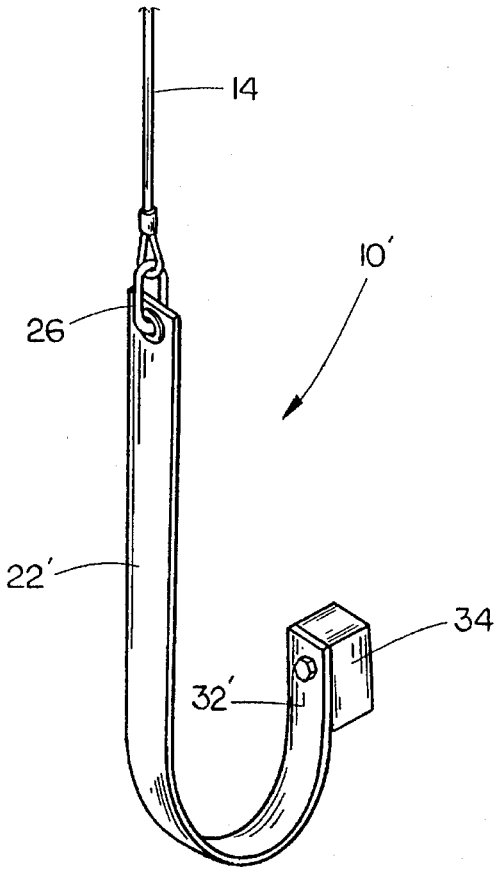
FIG. 2 is an enlarged perspective view of a second embodiment of the anchor of the present invention.

Referring now to FIG. 2, a second embodiment of the anchor is designed generally at 10' and includes a generally "J" shaped fluke 22' connected to rope 14 via ring 26 in the same fashion as anchor 10 of FIG. 1. In the second embodiment of anchor 10', a weight 34 is attached to the free end 32' of fluke 22'. Weight 34 assists in directing the free end 32' downwardly through the water so as to more easily engage a tree branch or other object on the bottom of the lake. Fluke 22' is formed of the same resilient material having memory, so that it may be bent to a generally straight position.

Figure 3:
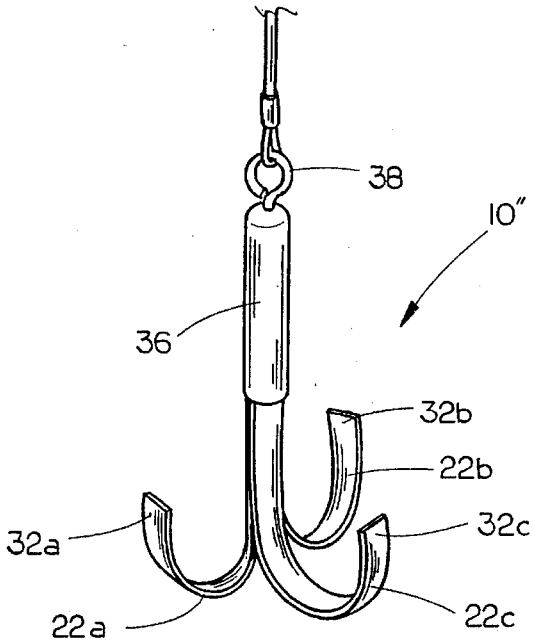

A third embodiment of the anchor is designated generally at 10" in FIG. 3. Anchor 10' includes three identical flukes **22*a*, 22*b* and 22*c* affixed together at their crown ends within a collar 36. Flukes 22*a*, b and c are generally "J" shaped, with their free ends 32*a*, 32*b* and 32*c* projecting radially outwardly from the longitudinal axis of collar 36, and spaced generally uniformly apart, to form a grapnel. Collar 36 has a ring 38 formed on an upper end to receive a rope or other connector attaching the anchor 10"** to a boat.

Whereas the invention has been shown and described in connection with the preferred embodiment thereof, many modifications, substitutions and additions may be made which are within the intended broad scope of the appended claims.

I claim:

1. A releasable anchor, comprising:

an elongated generally J-shaped fluke having an upper crown end and a lower free end, formed of a resilient spring steel material which has sufficient resilience to permit the fluke to be substantially straightened and which has memory to return the fluke to a J-shape after being substantially straightened said fluke formed of an elongated strap having a width greater than a thickness; and said strap being curved in a plane orthogonal to the thickness to form the J-shape.

2. The releasable anchor of claim 1, further comprising a weight affixed to the free end of the fluke, to direct the free end of the anchor's fluke downwardly through water.

3. The released anchor of claim 2, wherein the fluke has forward and rearward faces and is curved concavely on the forward face, and wherein said weight is affixed to the rearward face of the fluke.

4. The releasable anchor of claim 1, further comprising a second elongated generally J-shaped fluke having an upper crown end and a lower free end, formed of a resilient spring steel material which has sufficient resilience to permit the fluke to be substantially straightened and which has memory to return the fluke to a J-shape after being substantially straightened said first and second flukes being connected together at their upper ends with their respective free ends projecting outwardly in different directions.

5. The releasable anchor of claim 4, further comprising a third elongated generally J-shaped fluke having an upper crown end and a lower free end, formed of a resilient spring steel material which has sufficient resilience to permit the fluke to be substantially straightened and which has memory to return the fluke to a J-shape after being substantially straightened, said first and second and third flukes being connected together at their upper ends with their respective free ends projecting outwardly in different directions.

6. The releasable anchor claim 5, wherein said free ends are spaced uniformly apart around a central longitudinal axis of the anchor.

7. The releasable anchor claim 7, further comprising a vertically oriented collar having upper and lower ends, the crown ends of said flukes being mounted within the collar to depend from the lower end thereof to form a grapnel.

* * * * *